US007175539B2

(12) United States Patent
Sano

(10) Patent No.: US 7,175,539 B2
(45) **Date of Patent: *Feb. 13, 2007**

(54) GOLF CLUB HEAD

(75) Inventor: Yoshinori Sano, Kobe (JP)

(73) Assignee: SRI Sports Limited, Kobe (JP)

( * ) Notice: Subject to any disclaimer, the term of this patent is extended or adjusted under 35 U.S.C. 154(b) by 410 days.

This patent is subject to a terminal disclaimer.

(21) Appl. No.: 10/208,870

(22) Filed: Aug. 1, 2002

(65) Prior Publication Data

US 2003/0032497 A1 Feb. 13, 2003

(30) Foreign Application Priority Data

Aug. 1, 2001 (JP) ..... 2001-233844

(51) Int. Cl.
*A63B 53/00* (2006.01)

(52) U.S. Cl. ..... 473/324

(58) Field of Classification Search ..... 473/324, 473/349

See application file for complete search history.

(56) References Cited

U.S. PATENT DOCUMENTS 2,908,502 A * 10/1959 Bradstreet et al. ..... 473/330
4,204,684 A * 5/1980 Molitor ..... 473/349
5,338,024 A * 8/1994 Baum ..... 264/510
5,707,302 A * 1/1998 Leon et al. ..... 473/324
5,743,812 A * 4/1998 Card ..... 473/327
6,196,936 B1 * 3/2001 Meckel ..... 473/349
2002/0183133 A1 * 12/2002 Sano ..... 473/324

FOREIGN PATENT DOCUMENTS

JP 8-38004 2/1996
JP 11-318279 11/1999

* cited by examiner

*Primary Examiner*—Glenn Caldarola
*Assistant Examiner*—Tom P. Duong
(74) *Attorney, Agent, or Firm*—Birch, Stewart, Kolasch & Birch, LLP

(57) ABSTRACT

A golf club head including a basal body having a metallic surface, and a multilayer coating deposited on the metallic surface, wherein the multilayer coating includes a clear first layer deposited on the metallic surface and a colored clear second layer deposited on the clear first layer, whereby the basal body is visible through the multilayer coating. Preferably, the basal body has a mirror finish surface, satin finish surface, orange peel finish surface or the like under the multilayer coating. The multilayer coating further includes an iridescent layer deposited on the colored clear layer, wherein the iridescent layer includes an iridescent material which is dispersed therein while maintaining a certain degree of transparence.

12 Claims, 2 Drawing Sheets

GOLF CLUB HEAD

BACKGROUND OF THE INVENTION

The present invention relates to a golf club head and more particularly to a multilayer coating capable of improving the appearance of the golf club head.

In golf club heads, there are demands for beauty and high-quality impression in the appearance as well as demands for performance such as carry, directional controllability and like.

In recent years, on the other hand, there is a tendency for the wood-type golf clubs to increase the size or volume of the club head.

Sometimes, such a large volume head is felt to be heavy by the golf player although the actual golf club is not heavy, and this impression, different from the actual condition, tends to affect golf play which requires serious concentration.

A principal factor in the heavy impression of the golf club head is the appearance, namely, its coating, and it has been discovered that the heavy impression can be eliminated by improving the coating.

SUMMARY OF THE INVENTION

It is therefore, an object of the present invention to provide a golf club head in which a heavy impression of a large volume golf club head can be eliminated while enhancing the golfer's appreciation of its beauty and high-quality.

According to the present invention, the golf club head includes a basal body having a metallic surface, and a multilayer coating on the metallic surface, wherein the multilayer coating comprises a clear first layer on the metallic surface and a colored clear second layer on the clear first layer, and the basal body is visible through the multilayer coating.

Preferably, the basal body has a mirror finish surface, satin finish surface, an orange peel finish surface, or the like, under the multilayer coating. The multilayer coating further includes an iridescent layer on the colored clear layer, wherein the iridescent layer includes an iridescent material which is dispersed therein maintaining a certain degree of transparence.

Therefore, it becomes possible to give a light impression to the user.

BRIEF DESCRIPTION OF THE DRAWINGS

The present invention will become more fully understood from the detailed description given hereinbelow and the accompanying drawings, which are given by way of illustration only, and thus are not limitative of the present invention.

DESCRIPTION OF THE PREFERRED EMBODIMENT

Figure 1:
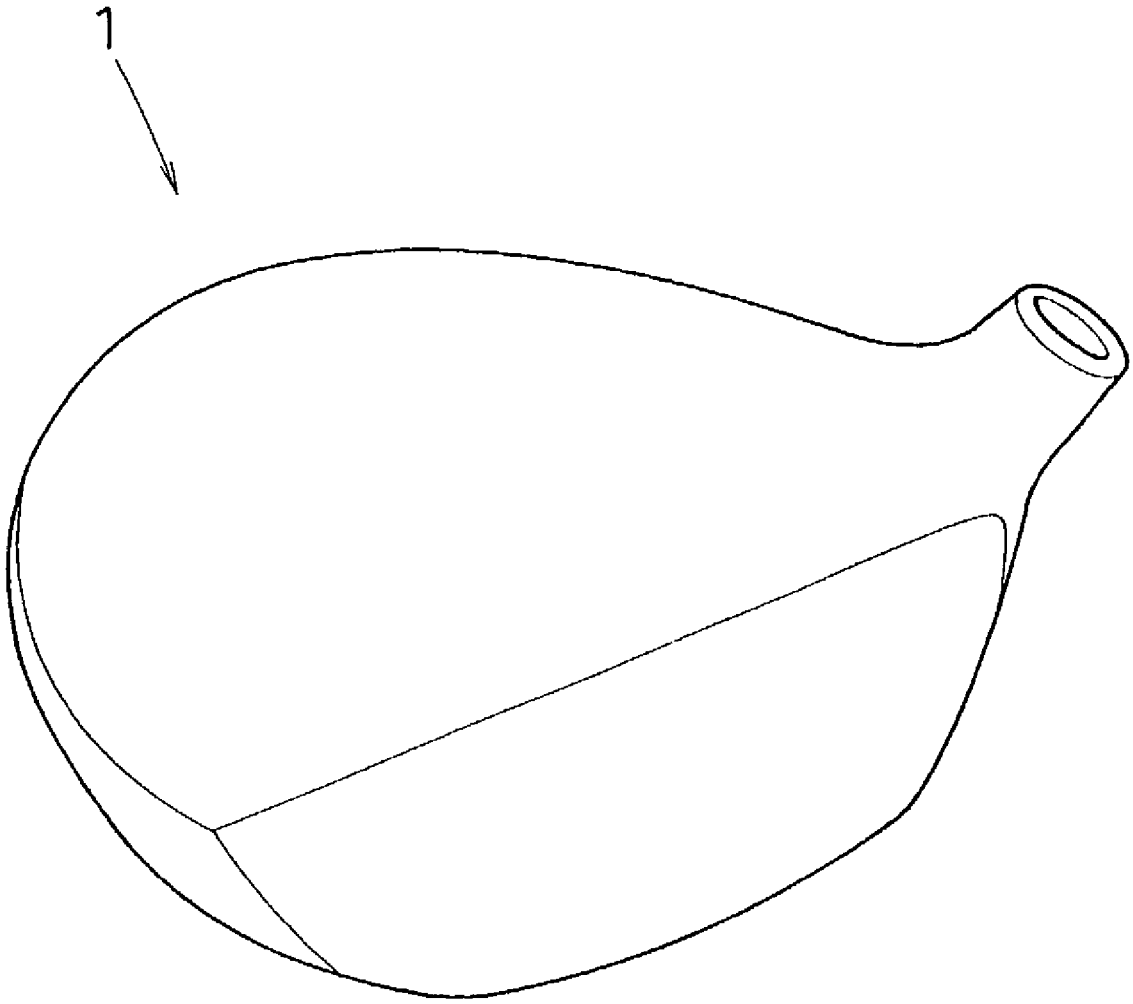
FIG. 1 is a perspective view of a wood-type golf club head according to the present invention.

An embodiment of the present invention will now be described in detail in conjunction with the accompanying drawings.

In this embodiment, golf club head 1 according to the present invention is a wood-type golf head comprising a metallic basal body, the surface of which excepting the sole is covered with a multilayer coating 3. Incidentally, the coating area can be determined according to the need.

The basal body 2 is made by assembling a plurality of parts made by casting, forging, pressing and the like of at least one kind of metallic material. In this embodiment, a titanium alloy is used in the parts because the strength-to-weight ratio is high. But, it is also possible to use other materials.

Needless to say, a pattern or design can be provided on the surface by various methods such as pressing, etching, cutting, filing and the like.

If need be, preparation of the surface of the basal body 2, e.g. polishing, wire brushing, sand blasting, cleaning and the like, is made in advance, and the surface to be coated is properly finished. As to the surface finish, for example, bright finish (or mirror finish), semibright finish, dull finish, satin finish (inclusive of hair line finish and matte finish), fine matte finish, orange peel finish and the like may be made on the surface. If the surface has a pinhole or the like, it should be stopped up with putty or the like in advance.

According to the present invention, a clear paint is firstly applied to the metallic surface of the basal body 2 to make a transparent colorless first layer 3*a*.

The clear paint is a transparent and colorless heat-hardening paint which contains a solvent and a synthetic resin such as a polyester, an epoxy, or an acrylic resin and the like as its base. In this embodiment, a polyester resin enamel is used because of its high impact strength and strong adhesion to metallic materials such as titanium alloy, stainless and the like. In order to harden, the applied clear paint is baked, for example at about 150 deg. C. for about 15 to 20 minutes, whereby a hard transparent colorless first layer 3*a* is formed.

The first layer 3*a* can also improve the adhesion to the under-mentioned overcoat.

The first layer 3*a* preferably has a thickness in a range of from 5 to 40 microns, more preferably 10 to 25 microns.

If the thickness is less than 5 microns, it is difficult to even the microscopic roughness of the metallic surface. If more than 40 microns, there is a tendency for the adhesion and impact resistance to decrease.

Secondly, a transparent color paint is applied to the surface of the transparent colorless first layer 3*a* to make a colored clear second layer 3*b*.

The transparent color paint is a transparent and colored heat-hardening paint which contains a solvent, a synthetic resin such as polyester, epoxy, acrylic resin and the like as its base, and colorant. As the colorant, dyestuff such as synthetic dye, vegetable dye, animal dye and mineral dye can be used alone or in combination. The dyestuff has a particle diameter which is very small in comparison with pigment, for example 1 to 2 nanometers, therefore, the paint is rendered transparent. However, another colorant may be used as far as it can render the paint transparent in effect.

In order to harden, the applied transparent color paint is baked, for example at about 150 deg. C. for about 15 to 20 minutes, whereby a hard colored clear second layer 3*b* is formed on the first layer 3*a*.

If the colored clear second layer 3*b* is too thin, it is difficult for the user to obtain the undermentioned depth perception. If too thick, the second layer 3*b* becomes brittle.

Therefore, it is preferable that the thickness of the colored clear second layer 3*b* is set in a range of from 10 to 50 microns, more preferably 20 to 40 microns.

In this embodiment, further, an iridescent third layer 3*c* is formed on the colored clear second layer 3*b* by applying an iridescent paint.

The iridescent paint is a liquid heat-hardening paint which contains a solvent, a transparent colorless synthetic resin such as polyester, polyurethane, epoxy, acrylic resin and the like as its base, and an iridescent material 4. A colorant such as pigment and dyestuff is not used in this embodiment.

As to the iridescent material 4, colored specular aluminum flakes, specular metal flakes whose surface is resin-treated, mica flakes coated with a titanium oxide, flakes of mica itself can be used. Here, the colored aluminum flakes means aluminum flakes colored by vapor deposition. It is not always necessary that the iridescent material itself is iridescent as long as the coating layer as a whole is iridescent. In case of material itself being iridescent, a chromatic polarizing material can be used. Anyway, the average size of the flake is set in a range of from about 10 to about 100 microns, wherein the size of a flake is defined as a maximum size in the normal direction to the thickness direction of the flake.

In this embodiment, an acrylic resin is used as the base resin, and colored aluminum flakes are used as the iridescent material. The colored aluminum flakes are preferable because it is easy to select a color and obtain the same color and a higher reflectance in comparison with other materials.

In order to harden, the applied iridescent paint is baked, for example at about 150 deg. C. for about 10 to 20 minutes, whereby a hard transparent iridescent third layer 3*c* is formed on the colored clear second layer 3*b*.

If the iridescent third layer 3*c* is too thin, the iridescent effect cannot be obtained. If too thick, the third layer 3*c* becomes brittle and the impact resistance decreases. Therefore, the thickness of the iridescent third layer 3*c* is set in a range of from 10 to 40 microns, preferably 15 to 35 microns. If the iridescent paint contains too much of the iridescent material 4, the iridescent material 4 covers the surface of the basal body 2 and it is difficult to obtain the depth perception. If not enough, it becomes difficult to obtain the iridescent effect. Therefore, the iridescent material 4 is set in a range of from 0.1 to 7.5%, preferably 0.5 to 5.5% in weight with respect to the total weight of the iridescent material and the base resin (excluding solvent).

The flakes 4 of the iridescent material may be dispersed randomly (not oriented), but it is preferable to orient them in a specific direction.

Figure 2:
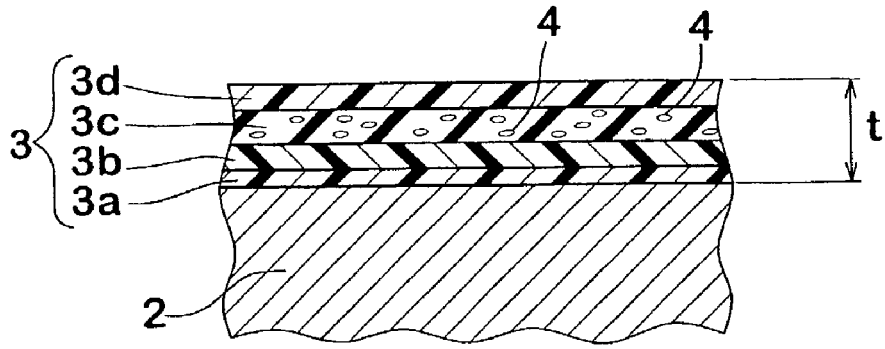
FIG. 2 is a cross sectional view of the multilayer coating thereof.

The flakes 4 can be oriented such that they become substantially parallel with the surface of the coating as shown in FIG. 2. This orientation may be preferably employed when the material itself is iridescent such as a chromatic polarizing material. In this case, in order to enhance the iridescent effect, relatively large flakes are preferably used as long as the flakes do not to hide the surface of the basal body.

Figure 3:
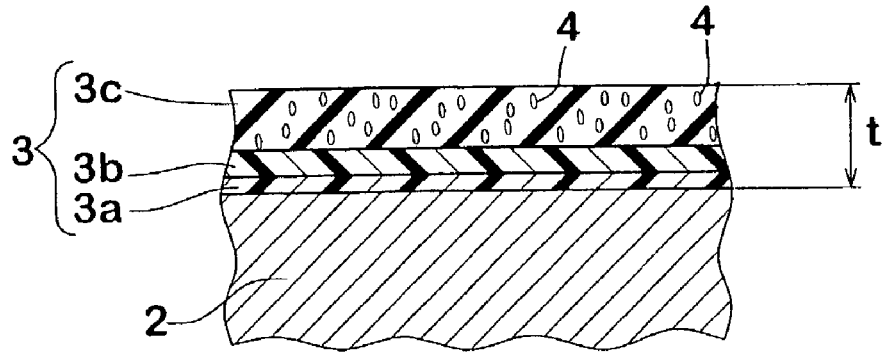
FIG. 3 is a cross sectional view of another example of the multilayer coating.

Further, as shown in FIG. 3, the flakes 4 can be oriented such that the flakes are disposed substantially normal to the surface of the coating, in other words, the thickness direction of the flakes become generally parallel with the surface of the coating. In this case, when the coating is viewed oppositely or normally thereto, the color is mainly determined by those of the second layer 3*b* and the surface of the basal body, but when viewed obliquely, as the percentage of the color of the iridescent material increases, the color as a whole changes. This orientation may be preferably employed when the material itself is not iridescent.

In any case, a color change also occurs by change in the incident light (direction and intensity) in addition to the change in the direction of view. Incidentally, the former orientation can be achieved by brush application of the iridescent paint, dipping, spraying or the like. The latter can be achieved by electrostatic spraying.

In this embodiment, furthermore, an outermost clear fourth layer 3*d* is formed on the iridescent third layer 3*c* by applying a clear paint in order to protect the iridescent third layer 3*c* and enhance the depth perception. It is however, possible to omit the outermost clear layer 3*d*, for example, if the third layer 3*c* is relatively thick as shown in FIG. 3.

The clear paint is a transparent and colorless heat-hardening paint which contains a solvent, and a synthetic resin such as a polyester, a polyurethane, an epoxy, or an acrylic resin and the like as its base.

The overall thickness (t) of the multilayer coating 3 is set in a range of not more than 100 microns, preferably 25 to 90 microns, more preferably 40 to 80 microns in view of the impact resistance, durability and the like.

The multilayer coating 3 is transparent and does not contain pigment, and the surface of the basal body 2 is visible through the multilayer coating 3. As a result, a depth perception occurs in human eyes, and many of the users do not obtain a heavy impression of a large volume head.

Comparison Tests

Using the basal body shown in FIG. 1 and described above, wood-type golf club heads were made, changing the specifications of the multilayer coating, and the appearance and impact resistance were evaluated with the results and specifications shown in Table 1.

Impact resistance test: A 500 gram iron bar was dropped on the multilayer coating from 150 mm height, and the multilayer coating was inspected for damage, including loss of the coating and the depth of the dent created in the coating and they were comprehensively evaluated into five ranks as to impact resistance, wherein the larger the rank number, the better the impact resistance.

As to the appearance, with respect to the transparency, metallic sheen and high-quality impression, ten golfers evaluated the multilayer coating into five ranks.

TABLE 1

| Club head | Ex. 1 | Ex. 2 | Ex. 3 | Ref. 1 | Ref. 2 | Ex. 4 | Ex. 5 |
|---|---|---|---|---|---|---|---|
| Basal body | satin | mirror | shot | shot | shot | satin | satin |
| Finishing method | sanding | polishing | blasting | blasting | blasting | sanding | sanding |
| Multilayer coating Thickness (micron) | | | | | | | |
| 1st first layer | 15 | 15 | 15 | 15 | 15 | 15 | 15 |
| 2nd colored clear layer | 30 | 30 | 30 | — | — | 5 | 55 |
| 2nd pigmented layer | — | — | — | 15 | 15 | — | — |
| 3rd iridescent layer | 20 | 20 | 20 | — | 20 | 20 | 20 |
| 4th clear layer | 20 | 20 | 20 | 20 | 20 | 20 | 20 |

TABLE 1-continued

| Club head | Ex. 1 | Ex. 2 | Ex. 3 | Ref. 1 | Ref. 2 | Ex. 4 | Ex. 5 |
|---|---|---|---|---|---|---|---|
| Test results | | | | | | | |
| Impact resistance | 5 | 5 | 5 | 5 | 5 | 5 | 3 |
| Appearance | | | | | | | |
| Transparency | 5 | 5 | 5 | 1 | 2 | 3 | 5 |
| Metallic sheen | 5 | 5 | 3 | 1 | 1 | 5 | 4 |
| High-quality impression | 5 | 5 | 4 | 2 | 3 | 3 | 5 |

The present invention can be suitably applied to a wood-type golf club head having a large volume in order to eliminate a heavy impression therefrom. However, as the present invention is effective in improving the appearance of the club head, it can be suitably applied to iron-type, utility-type and putter-type golf club heads as long as the surface of the basal body is formed of a metallic material or the surface is a metallic surface regardless of the actual material.

The invention claimed is:

1. A golf club head comprising a basal body having a metallic surface and a multilayer coating provided on the metallic surface, wherein the multilayer coating comprises a clear first layer disposed on the metallic surface, a colored clear second layer disposed on the clear first layer, and an iridescent third layer formed on the colored clear second layer by applying an iridescent paint comprising a solvent, a transparent colorless synthetic resin and an iridescent material, the iridescent material in the iridescent third layer dispersed to maintain a certain degree of transparence of the iridescent third layer, whereby the metallic surface of the basal body is visible through the multilayer coating.

2. The golf club head according to claim 1, wherein the multilayer coating comprises said first, second and third layers and further an outermost clear layer whereby the metallic surface of the basal body is visible through the multilayer coating.

3. The golf club head according to claim 1 or 2, wherein the basal body has a mirror finish surface under the multilayer coating.

4. The golf club head according to claim 1 or 2, wherein the basal body has a satin finish surface under the multilayer coating.

5. The golf club head according to claim 1 or 2, wherein the basal body has a orange peel finish surface under the multilayer coating.

6. The golf club head according to claim 1, wherein the iridescent material is at least one of colored specular aluminum flakes, specular metal flakes which surfaces are resin-treated, mica flakes, coated with a titanium oxide, and flakes of mica itself, and the average size of the flake is in the range of from about 10 to about 100 microns.

7. The golf club head according to claim 1, wherein the iridescent material is a chromatic polarizing material.

8. The golf club head according to claim 1, wherein the transparent colorless synthetic resin is at least one of a polyester, a polyurethane, an epoxy and an acrylic resin.

9. A golf club head according to claim 1, wherein the iridescent paint does not contain a colorant.

10. The golf club head of claim 1, wherein the first layer has a thickness of from 5 to 40 microns.

11. The golf club head of claim 1, wherein the colored clear second layer has a thickness of from 10 to 50 microns.

12. The golf club head of claim 1, wherein the iridescent third layer has a thickness of 10 to 40 microns.

* * * * *